United States Patent [19]

Erickson

[11] Patent Number: 4,582,518

[45] Date of Patent: Apr. 15, 1986

[54] NITROGEN PRODUCTION BY LOW ENERGY DISTILLATION

[76] Inventor: Donald C. Erickson, 1704 S. Harbor La., Annapolis, Md. 21401

[21] Appl. No.: 654,481

[22] Filed: Sep. 26, 1984

[51] Int. Cl.[4] ..... F25J 3/04

[52] U.S. Cl. ..... 62/25; 62/28; 62/29; 62/31; 62/34; 62/39

[58] Field of Search ..... 62/31, 34, 23, 24, 27, 62/28, 29, 30, 38, 39, 22, 25

[56] References Cited

U.S. PATENT DOCUMENTS 4,439,220 3/1984 Olszewski et al. ..... 62/31

4,448,595 5/1984 Cheung ..... 62/31

*Primary Examiner*—Frank Sever

[57] ABSTRACT

The invention provides a means of producing high purity nitrogen at high recovery with lower energy requirement than has been possible heretofore. This is done with an elevated pressure dual pressure distillation column arrangement wherein the low pressure column (at about 4 ATA pressure) (component 102 in FIG. 1) is reboiled by partially condensing supply air in 103 and is refluxed both by direct injection of $LN_2$ from the HP rectifier 105 plus latent heat exchange with depressurized LP column bottom liquid in 114, and the HP rectifier is refluxed by latent heat exchange with either LP column intermediate liquid in 106 and/or depressurized kettle liquid.

18 Claims, 2 Drawing Figures

NITROGEN PRODUCTION BY LOW ENERGY DISTILLATION

TECHNICAL FIELD

Process and apparatus are disclosed for distilling air to produce high yields of high purity nitrogen at lower energy consumption than has been possible heretofore. The disclosure also applies to other subambient distillations.

BACKGROUND ART

Recent large increases in demand for nitrogen have been experienced. One primary cause has been enhanced oil recovery by injection of pressurized nitrogen into the well. Production is required on a very large scale and at very high purity (typically less than 5 ppm $O_2$). Under these conditions, the energy requirement of the producing plant is a major component of the cost of the nitrogen. Accordingly much recent attention has been devoted to lowering the energy required for producing nitrogen.

Prior art patents which disclose reduced energy approaches to dual pressure distillative production of nitrogen include U.S. Pat. Nos. 4,453,957, 4,448,595, 4,439,220, 4,222,756, and British Pat. No. 1,215,377. These all involve supplying feed air to a high pressure rectifier, then routing the rectifier bottom product either directly or indirectly to a low pressure distillation column, and several also involve supplying reboil to the low pressure column by latent heat exchange with vapor from the HP rectifier. They also all incorporate a means of increasing the reflux at the top of the LP column, whereby $N_2$ purity and yield are increased, by exchanging latent heat between LP column overhead vapor and boiling depressurized LP column bottom product.

The '377 patent was one of the earliest disclosures of the basic configuration described above. It included the option of withdrawing some product $N_2$ from the HP rectifier overhead, in addition to that withdrawn from the LP column overhead. The '957 patent discloses the same basic configuration, with the modifications of a different method of producing refrigeration and elimination of any transport of liquid $N_2$ from the HP rectifier overhead to the LP column overhead. The '756 patent also involves the same basic configuration, also eliminates flow of $LN_2$ from HP rectifier overhead to LP column overhead, and discloses yet another variation for producing refrigeration.

The '220 and '595 patents do not involve reboiling the LP column by latent heat exchange between HP rectifier vapor and LP column liquid. Rather, both of those patents disclose refluxing the HP rectifier by exchanging latent heat with boiling depressurized kettle liquid (HP rectifier bottom product). The at least partially evaporated kettle liquid is then fed into the LP column for further separation. This same technique has been disclosed in processes for producing low purity oxygen, e.g. U.S. Pat. Nos. 4,410,343 and 4,254,629. The latter patent explains by means of a McCabe-Thiele diagram the advantage of this technique--that feeding 40% $O_2$ vapor to the LP column is more efficient than feeding 40% $O_2$ liquid to the same column.

The differences between the '220 patent and the '595 patent are that in the '220 patent the LP column is solely a rectifier with no source of reboil other than the vapor feed to it, whereas in the '595 patent the LP column has a stripping section and a reboiler supplied by total condensation of a minor fraction of the feed air. The latter means of reboiling the LP column is also disclosed in the U.S. Pat. No. 4,410,343 for low purity oxygen producing processes.

Reboiling the medium pressure column of a three column triple pressure configuration for producing high purity oxygen by latent heat exchange with partially condensing supply air is disclosed in U.S. Pat. No. 3,688,513. Providing intermediate reboil to a low pressure column by latent heat exchange between HP rectifier overhead vapor and partially evaporating LP column intermediate height liquid is disclosed in U.S. Pat. No. 4,372,765.

The '220 patent has the disadvantage that the $N_2$ recovery is low. Since the LP column is only a rectifier, the $N_2$ content of the vapor feed (about 60%) sets a lower limit on the $N_2$ content of the LP bottom liquid (about 40%), and hence recoveries only on the order of 80% are possible.

The '595 patent has the disadvantage of requiring significantly higher feed pressures than are actually necessary, while achieving lower recoveries than are possible, due to inefficiencies involved in reboiling the LP column by total condensation and in feeding evaporated kettle liquid to the LP column.

DISCLOSURE OF INVENTION

The disadvantages of the prior art are overcome by providing a dual pressure air distillation process or apparatus in which: cooled and cleaned supply air at a single pressure is routed initially to partial condenser which reboils the bottom of the LP column, and then at least a major fraction of the remaining uncondensed air is introduced into the HP rectifier, where it is rectified to kettle liquid bottom product and high purity overhead nitrogen. At least 15% and as much as 100% of the nitrogen overhead product is obtained as liquid and is routed to the LP column overhead where it is directly injected as part of the reflux therefor. The remaining LP column overhead reflux is obtained by latent heat exchange with boiling depressurized LP column bottom liquid. The HP rectifier is refluxed by latent heat exchange with at least one of boiling kettle liquid and boiling LP column intermediate height liquid.

The unexpected energy advantages made possible by partial condensation reboiling of the LP column by the supply air are only realized when the temperature difference between the top and bottom of the HP rectifier is approximately the same as the temperature difference between the bottom of the LP column and the LP column intermediate height where its vapor rate is substantially increased, either by intermediate reboil or by introduction of vapor feed (or both). Since the HP rectifier $\Delta T$ is usually 6° to 7° F., the corresponding LP bottom to LP intermediate height $\Delta T$ should be 5° to 8° F. When the HP rectifier overhead is refluxed by latent heat exchange with LP column intermediate height liquid, this is easily accomplished by choosing the appropriate tray height for the intermediate height, and selecting an LP column bottom reboil rate to just reach that tray height without pinching out. The LP column bottom section L/V necessary for that will be about 2.0 to 2.5, and usually about 2.2. This is adjusted by the amount of reboiler heat exchange surface provided. This will apply for a fairly wide range of $N_2$ content in the LP column bottom liquid, e.g. 2% to 35%. On the other hand, if HP rectifier reflux is via latent heat exchange with kettle liquid, only a much more limited range of LP column bottom liquid concentrations can be tolerated--roughly 17% to 25% $N_2$ in the liquid. This is because the evaporated kettle liquid has a fixed composition of about 66% $N_2$, and therefore a fixed (equilibrium) entry point into the LP column, and hence only a narrow range of bottom compositions will be within 5° to 8° F. of that entry point temperature. If reflux is by partial evaporation of kettle liquid vice total evaporation, then higher $N_2$ content vapor is introduced into the LP column, which allows somewhat higher bottom liquid $N_2$ contents (above 25%) while still retaining the low energy advantage.

The refrigeration necessary for the process can be developed in two preferred ways, or in other ways known in the prior art. The preferred ways are to either partially warm part of the HP rectifier $N_2$ overhead product, expand it to slightly below LP column pressure, and add it to the product gas withdrawn from the LP column; or to partially warm an air stream taken from just before or preferably just after the partial condensation reboiler, expand it to LP column pressure, and introduce it into the LP column at an intermediate height which is above that associated with the HP rectifier reflux.

The former approach is slightly preferred, since the expanded $N_2$ needn't be cooled back to LP column temperature, and the LP column diameter is somewhat smaller.

With either refrigeration option above, and also with either HP rectifier reflux option, it is also possible to withdraw part of the $N_2$ product from the HP rectifier overhead, although the major fraction of product will be withdrawn from the LP column overhead. It is also possible to coproduce low purity oxygen of from 70 to 95% purity, by adjusting the $N_2$ content of the LP column bottom liquid.

BEST MODE FOR CARRYING OUT THE INVENTION

Figure 1:
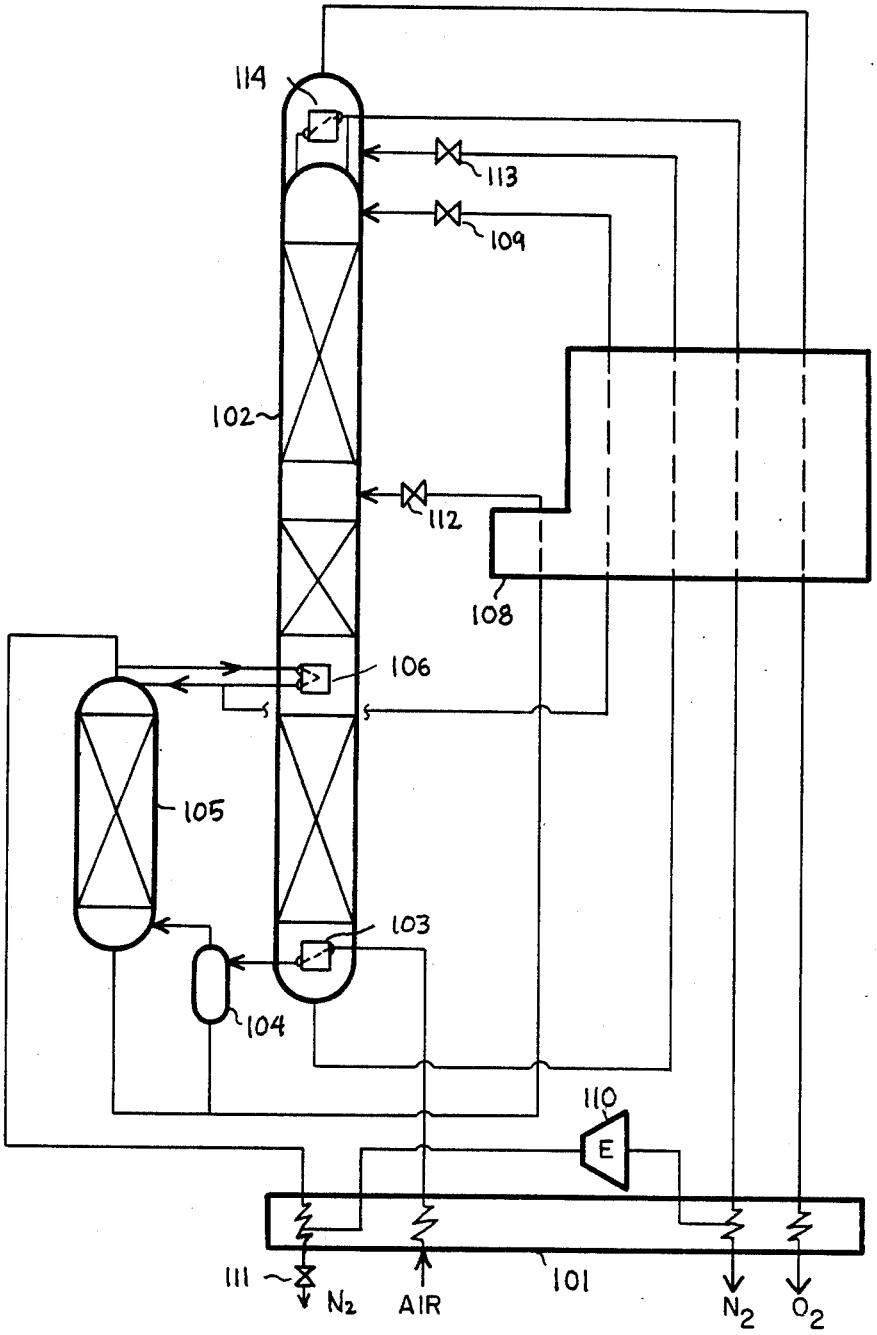
FIG. 1 is a schematic representation of the preferred embodiment wherein HP rectifier reflux is via latent heat exchange with LP column intermediate height liquid, and refrigeration is developed by expanding part of the HP rectifier overhead product and then adding it to the LP nitrogen product.

Referring to FIG. 1, block 101 represents the apparatus for cleaning and cooling the supply air and rewarming the vapor streams exiting the cold box, and may be a reversing exchanger, regenerator, conventional exchanger with mole sieve cleanup, or other configurations known in the art. 102 is the low pressure distillation column, having partial condensation bottoms reboiler 103 which receives the cooled and cleaned supply air. The partially condensed air, having at most about 30% liquid phase, is routed to optional phase separator 104, from which the uncondensed fraction of the supply air enters high pressure rectifier 105. Intermediate reboiler 106 supplies intermediate reboil to LP column 102 and overhead reflux to HP rectifier 105, and also supplies overhead product liquid nitrogen which is routed via subcooler 108 and expansion valve 109 to direct injection into LP column 102 overhead. Additional overhead product from HP rectifier 105 is withdrawn in vapor phase; and is expanded in refrigeration expander 110 after partial warming in heat exchange apparatus 101, plus optionally a minor fraction may be withdrawn as high pressure product via valve 111. The bottom liquid from HP rectifier 105 (kettle liquid), which may be combined with condensate from partial condensation reboiler 103, is routed via subcooler 108 and expansion valve 112 into LP column 102 as feed therefor, at a height above intermediate reboiler 106 height. The LP column bottom product liquid is also cooled in subcooler 108 and is expanded by valve 113 into reflux condenser 114, where it is boiled by latent heat exchange with condensing LP column overhead nitrogen. Product nitrogen at LP column pressure is withdrawn from the LP column overhead.

The following example operating conditions for the embodiment of FIG. 1 are based on a computer simulation of that flowsheet. 100 moles/second (m) of air is compressed to 117 psia, and after cooling and cleaning enters reboiler 103 at about 112.4 psia. 22 m of the air condenses in 103, and the partially condensed mixture exits at −273.6° F. 78 m of uncondensed air enters the HP rectifier at 112.2 psia, with an overhead pressure of 110 psia and about 40 theoretical stages. The overhead and bottom temperatures are −280.3° F. and −273.8° F. respectively, for a column ΔT of 6.5° F. The overhead product, at less than 5 ppm $O_2$ purity, consists of 14 m of liquid $N_2$ which is routed to the LP column overhead, plus 18.8 m of gaseous $N_2$ which is used for refrigeration producing expansion plus, depending on the refrigeration needs, direct withdrawal at pressure. 45.2 m of kettle liquid is combined with 22 m condensate to yield 67.4 m of liquid containing 67.5% $N_2$, which is expanded into the LP column. 27.5 m of LP column bottom product containing 20% $N_2$ is expanded to 17.6 psia and totally evaporated to a vapor at −297.6° F. by heat exchange with LP column overhead $N_2$ at 59.3 psia and −295° F. The LP column has about 46 theoretical trays, and intermediate reboiler 106 is located about 6 trays from the bottom, where the pressure is 62 psia, the temperature is −283° F., and the vapor and liquid phases contain 66% $N_2$ and 41% $N_2$ respectively. The LP column bottom temperature is −276.3° F., and hence the LP column ΔT between reboilers 103 and 106 is 6.7° F., or very close to the 6.5° F. ΔT of the HP rectifier. The bottom section of the LP column has an L/V of about 2.2, whereas the V/L of the HP rectifier and LP rectifying section are about 1.65 and 1.8 respectively.

The expander exhaust $N_2$ is added to that from the LP column overhead, yielding 72.5 m of high purity $N_2$ (below 5 ppm $O_2$) at a pressure of 57 psia (exit the heat exchanger) plus 27.5 m of atmospheric pressure waste gas containing 76% $O_2$. Thus the $N_2$ recovery is about 93% of that supplied the apparatus.

The above example of approximate conditions which can be expected in an operating plant reveals the unexpected energy reduction advantage obtained from partial condensation reboiling of the LP column (in conjunction with the other disclosed measures necessary to realize this advantage). The 100 m of air supplied the reboiler at 112.4 psia has a dewpoint of about −272.3° F. By the time that 22 m of the air is condensed, its temperature is −273.6° F. Thus the average effective temperature of latent heat release is about −272.9° F. This provides a satisfactory reboiler heat exchange ΔT of 3.4° F. with the −276.3° F. LP column bottom liquid. If however, only 22 m of air at 112.4 psia were supplied to reboiler 103 for total condensation reboil, the dewpoint would be the same, but the exiting bubble pt. temperature would be −276.5° F. However this is impossible, as it is actually colder than the LP column bottoms. In order to achieve the same average heat delivery temperature of 272.9° F. by total condensation without temperature crossing at the cold end, it is necessary to raise the pressure to 117.4 psia. The lower supply pressure possible with the partial condensation approach equates to a lower energy requirement provided similar recoveries and product pressures are achieved. The disclosed process actually achieves higher recoveries than most prior art low energy processes (93% in the example), which even further increases the realized energy savings. The high recovery is contingent upon the essential transfer of liquid $N_2$ from the HP rectifier to the LP column as reflux, which is contraindicated in the closest prior art disclosures. In the above example, in which the HP rectifier overhead product was 14+18.8=32.8 m, 14 m or 42.7% of that product was supplied as LP column reflux. In general at least 15% and preferably more than 30% must be so supplied to achieve the disclosed low energy plus high recovery of high purity nitrogen.

One additional precaution is important in order to achieve advantageous results with the FIG. 1 flowsheet. The latent heat exchange from HP rectifier overhead vapor to LP column intermediate liquid should preferably be by partial evaporation of the LP column intermediate liquid, as opposed to total evaporation. The reason here is similar to that described above: if only sufficient liquid is provided the intermediate reboiler such that total evaporation is required rather than partial evaporation, then the exiting vapor composition is the same as the entering liquid composition. The proper feed point for such a vapor, i.e., the tray having a vapor composition most closely approaching that vapor, would be several trays higher and colder than the tray where the liquid came from. Thus the vapor is introduced into the LP column several trays higher than necessary, requiring more reboil in the lower section of the LP column to avoid pinching out, and hence resulting in slightly less efficient operation.

The way to avoid the disadvantageous total evaporation intermediate reboiling is to supply more liquid to the reboiler than is actually evaporated, with the excess returned to the column as reflux. This is very easily done when the intermediate reboiler is physically located inside the LP column, as indicated schematically on FIG. 1. Obviously, however it could also be done for other reboiler locations.

Figure 2:
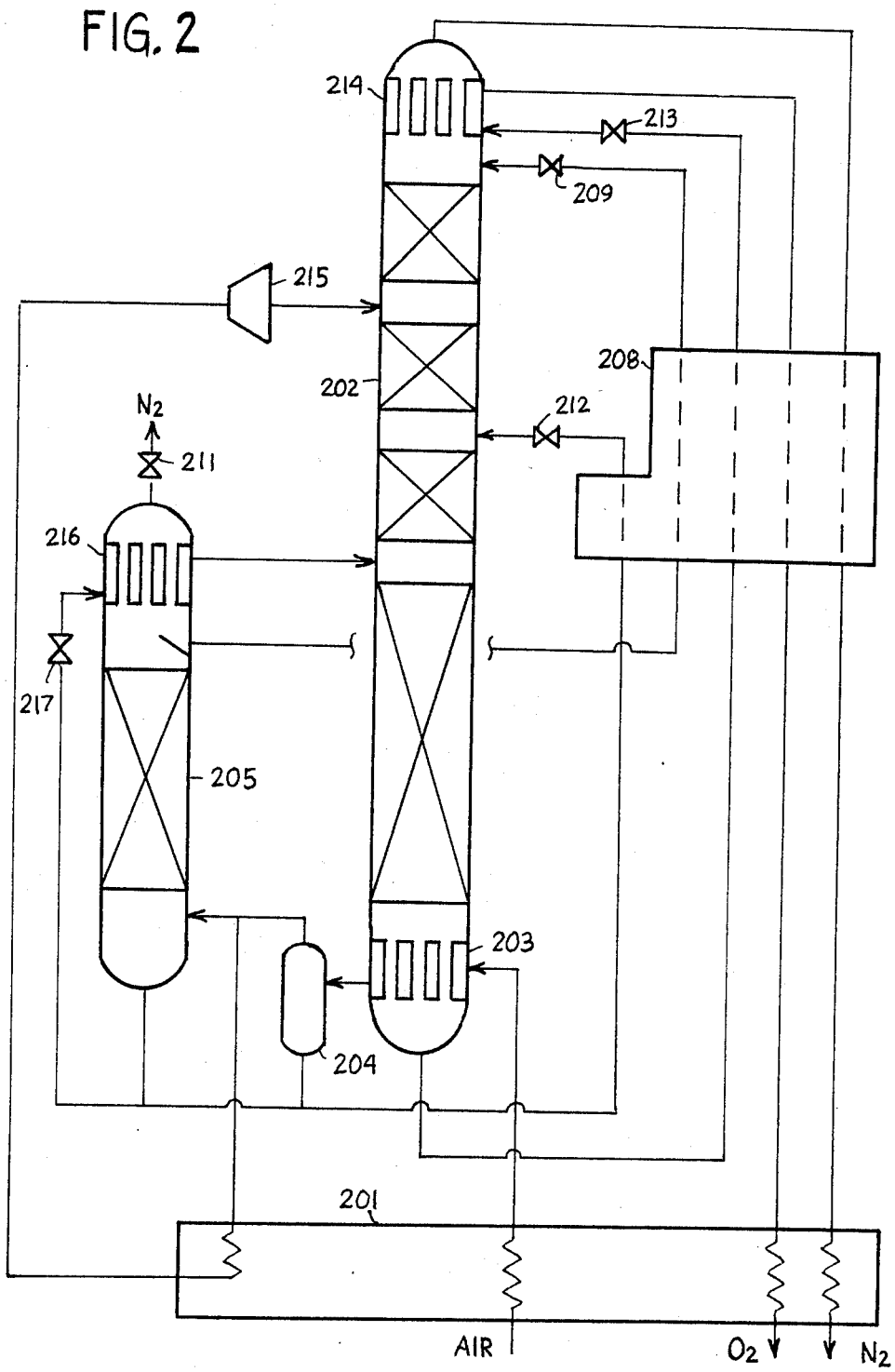
FIG. 2 illustrates an alternative embodiment wherein HP rectifier reflux is via latent heat exchange with boiling depressurized kettle liquid, and refrigeration is via expanding part of the uncondensed air out of the partial condenser and then introducing it into the LP column.

Referring to FIG. 2, two options to the FIG. 1 flowsheet are illustrated: using air vice $N_2$ for refrigeration expansion, and refluxing the HP rectifier by evaporating kettle liquid vice LP column intermediate liquid. Either of these options may be applied individually to the FIG. 1 flowsheet also, and at least in some conditions will achieve equally advantageous results. The 200-series components correspond to the 100-series counterparts of FIG. 1, i.e., 201 corresponds to 101, and only the new components will be further described.

Instead of all the uncondensed fraction of air from reboiler 203 and phase separator 204 being routed to HP rectifier 205, only a major fraction is so routed, and a minor fraction, (depending on refrigeration requirements about 6 to 20% of the air supply) is routed to partial warming and then expansion in work-producing expander 215, and subsequently is fed into LP column 202 above the liquid feed introduction height (from valve 212). A major fraction (from 50 to 100% of the HP rectifier overhead product is obtained in liquid phase and routed via subcooler 208 and expansion valve (i.e. pressure reducing valve) 209 for injection into the LP column overhead as reflux therefor. Any remaining HP rectifier overhead product may be withdrawn at pressure via valve 211. The HP rectifier reflux and the liquid $N_2$ overhead product are obtained from reflux condenser 216, which is supplied depressurized liquid via valve 217 from HP rectifier 205 and phase separator 204, and which in turn supplies vapor feed to LP column 202 at a height below the liquid feed height. The remaining liquid from rectifier 205 and separator 204 is routed via subcooler 208 and pressure reduction valve 212 and fed to the LP column.

It will be realized with respect to both of the above flowsheets plus obvious variants that different physical configurations may be encountered without departing from the basic disclosed function, e.g. various other sensible heat exchange configurations, providing multiple units for some functions, and the like. Also different operating conditions may be employed, for instance different heat exchanger ΔT's, component pressure drops, ambient pressure and temperature, and the like. It is known to remove products from different locations (tray heights) to achieve more than one purity. Whereas the disclosed process can produce high purity nitrogen of less than about/5 ppm oxygen impurity, clearly it can also produce lesser nitrogen purities. LP column pressures of 50 to 80 psia, with HP rectifier pressures of no more than twice the LP column pressure, are achievable with this disclosure.

I claim:

1. A process for separating nitrogen from cleaned and cooled supply air at a single pressure in a distillation apparatus comprised of a high pressure rectifier and a low pressure distillation column comprising:

(a) supplying at least a major fraction of the feed air at a pressure in the approximate range of 100 to 160 psia to the bottoms reboiler of the LP column;

(b) condensing a minor fraction of the air in said reboiler;

(c) supplying at least a major fraction of the remaining uncondensed air to the HP rectifier;

(d) rectifying said uncondensed air to overhead nitrogen and kettle liquid bottom product;

(e) feeding the kettle liquid to the LP column;

(f) providing intermediate reboil to the LP column and a supply of liquid nitrogen overhead reflux to the HP rectifier by exchanging latent heat between condensing HP rectifier overhead nitrogen vapor and evaporating LP column intermediate height liquid:

(g) obtaining between 15 and 100% of the HP rectifier overhead product as liquid and directly injecting it into the LP column overhead as reflux therefor;

(h) providing additional reflux to the LP column overhead by indirect exchange of latent heat with boiling depressurized LP column bottom product;

(i) recovering approximately 85 to 99.5% of the $N_2$ contained in the supply air as product.

2. The process according to claim 1 further comprising work-expanding part of the gaseous overhead product of the HP rectifier to the pressure of the LP column overhead product to develop refrigeration, and recovering both streams as product.

3. The process according to claim 2 further comprising recovering nitrogen containing no more than about 5 ppm oxygen impurity as product, and controlling the nitrogen content of the LP column bottom product between 2 and 35%, and locating the LP column intermediate reboiler at a height where the column temperature is between about 5° and 9° F. colder than the column bottom temperature.

4. The process according claim 3 further comprising controlling LP column pressure between about 50 and 80 psia, and the HP rectifier pressure at no more than about twice the LP column pressure.

5. The process according to claim 4 further comprising partially evaporating the LP column intermediate height liquid in the intermediate reboiler, and locating the intermediate reboiler at a height below the kettle liquid feed height.

6. The process according to claim 5 further comprising recovering part of the gaseous HP rectifier overhead product as pressurized product.

7. The process according to claim 5 further comprising co-producing oxygen of up to 95% purity.

8. The process according to claim 1 further comprising work-expanding part of the supply air to produce refrigeration and introducing said expanded air into the low pressure column at a tray height above the kettle feed height.

9. The process according to claim 1 further comprising work expanding part of the uncondensed air from the partial reboiler and introducing the expanded gas into the low pressure column for recovery of the nitrogen content.

10. A subambient distillation apparatus designed, dimensioned, and arranged for separating nitrogen from a single pressure supply of cleaned and cooled air comprising:

(a) a low pressure distillation column, and a means for supplying cleaned and cooled air in the approximate pressure range of 100 to 160 psia;

(b) a partial condensation bottoms reboiler for said LP column, including means for supplying at least a major fraction of said air to said reboiler;

(c) a high pressure rectifier, including means for supplying the uncondensed air from said reboiler as feed to said rectifier;

(d) means for refluxing said rectifier and for supplying a source of liquid nitrogen to partially reflux said LP column comprising at least one of:

(i) means for exchanging latent heat between rectifier overhead vapor and LP column intermediate height liquid, and;

(ii) means for exchanging latent heat between rectifier overhead vapor and reduced pressure rectifier bottom liquid;

(e) means for supplying said source of liquid nitrogen to reflux said LP column overhead;

(f) means for providing additional reflux to said LP column by exchanging latent heat between LP column overhead vapor and depressurized LP column bottom liquid; and (g) means for recovering from the LP column overhead and the rectifier overhead gaseous high purity nitrogen in the amount of 85 to 99.5% of the $N_2$ present in said supply air.

11. The apparatus according to claim 10 further comprised of a refrigeration producing expander which is supplied partially warmed rectifier overhead vapor.

12. The apparatus according to claim 11 further comprised of means for recovering the expanded rectifier overhead vapor as part of the product.

13. The apparatus according to claim 10 further comprising a means for expanding a minor fraction of the uncondensed vapor from the partial condensation reboiler and a means for supplying the expanded vapor to the low pressure column.

14. The apparatus according to claim 11 or 13 wherein the only source of HP rectifier reflux is the LP column intermediate reboiler.

15. The apparatus according to claim 11 or 13 wherein the only source of HP rectifier reflux is by latent heat exchange with kettle liquid at reduced pressure.

16. A process for separating nitrogen from cleaned and cooled supply air at a single pressure in a distillation apparatus comprised of a high pressure rectifier and a low pressure distillation column comprising:

(a) supplying at least a major fraction of the feed air to the bottoms reboiler of the LP column;

(b) condensing a minor fraction of the air in said reboiler; thus obtaining an air-derived condensate;

(c) supplying at least a major fraction of the remaining uncondensed air to the HP rectifier;

(d) rectifying said uncondensed air to overhead nitrogen and kettle liquid bottom product;

(e) providing reflux to the HP rectifier and obtaining at least part of the HP rectifier overhead product in liquid phase for subsequent supply to the LP column overhead by exchanging latent heat with at least one of:

(i) depressurized kettle liquid (ii) depressurized air-derived condensate (iii) LP column intermediate height liquid;

(f) supply said cooled and cleaned air at a supply pressure in the approximate range of 100 to 160 psia;

(g) recovering approximately 85 to 99.5% of the $N_2$ contained in the supply air as product;

(h) obtaining between 50 and 100% of the HP rectifier overhead product as liquid and directly injecting it into the LP column overhead as reflux therefor;

(i) providing additional reflux to the LP column overhead by indirect exchange of latent heat with boiling depressurized LP column bottom product.

17. The process according to claim 16 further comprised of partially warming and expanding part of the HP rectifier overhead product nitrogen and recovering the expanded nitrogen as product.

18. The process according to claim 16 further comprised of partially warming and work-expanding a minor fraction of the uncondensed air from the partial condensation reboiler, and feeding the expanded gas to the LP column.

* * * * *